United States Patent [19]

Huber-Emden et al.

[11] Patent Number: 4,990,164

[45] Date of Patent: Feb. 5, 1991

[54] PROCESS FOR THE PHOTOCHEMICAL STABILIZATION OF UNDYED AND DYED POLYAMIDE FIBRE MATERIAL AND BLENDS THEREOF WITH COPPER COMPLEX OF HYDROXY-SALICYL-OYL-HYDROXYLAMINE DERIVATIVE

[75] Inventors: Helmut Huber-Emden, Schönenbuch; Gerhard Reinert, Allschwill, both of Switzerland

[73] Assignee: Ciba-Geigy Corporation, Ardsley, N.Y.

[21] Appl. No.: 413,370

[22] Filed: Sep. 27, 1989

[30] Foreign Application Priority Data

Sep. 29, 1988 [CH] Switzerland ..... 3621/88

[51] Int. Cl.[5] ..... C07F 1/08; D06P 1/64; D06P 3/24; D06M 13/50

[52] U.S. Cl. ..... 8/442; 8/529; 8/531; 8/602; 8/607; 8/608; 8/624; 8/924; 8/926

[58] Field of Search ..... 8/442, 602, 607, 608, 8/624, 531

[56] References Cited

U.S. PATENT DOCUMENTS 4,544,372 10/1985 Heise et al. ..... 8/602
4,613,334 9/1986 Thomas et al. ..... 8/442
4,655,830 4/1987 Reinert et al. ..... 8/115.66
4,704,133 11/1987 Reinert et al. ..... 8/442
4,775,386 10/1988 Reinert et al. ..... 8/442
4,874,391 10/1989 Reinert ..... 8/442

*Primary Examiner*—A. Lionel Clingman
*Attorney, Agent, or Firm*—George R. Dohmann; Kevin T. Mansfield

[57] ABSTRACT

A process is described for the photochemical stabilization of undyed and dyed polyamide fibre material, and blends thereof with other fibres, using photochemically stabilizing compositions based on copper compounds of phenols, which process comprises treating the polyamide fibre material with fibre-reactive organic copper complexes of the reaction products of o-hydroxybenzoyl derivatives of the formula

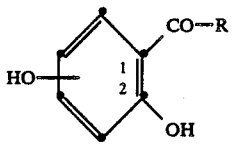

(1)

wherein R is hydrogen or $C_1$–$C_4$ alkyl and the OH substituent is located in the 3-, 4- or 5-position, with aliphatic diamines or hydroxylamine. The copper complex compounds are distinguished by a high rate of exhaustion on to the polyamide fibre material, a feature which is significant in economic terms because of the low consumption of product.

9 Claims, No Drawings

PROCESS FOR THE PHOTOCHEMICAL STABILIZATION OF UNDYED AND DYED POLYAMIDE FIBRE MATERIAL AND BLENDS THEREOF WITH COPPER COMPLEX OF HYDROXY-SALICYL-OYL-HYDROXYLAMINE DERIVATIVE

The present invention relates to a process for the photochemical stabilization of undyed and dyed polyamide fibre material and blends thereof with other fibres, by treating said material with photo-chemically stabilizing compositions based on copper compounds of phenols.

It is commonly known to use copper salts, e.g. copper sulfate, to improve the lightfastness of dyeings on polyamide fibres obtained with metal complex dyes. Reference is made in this connection to the article by I. B. HANES in ADR 3 (1980), pages 19 and 20. However, inorganic or organic copper salts frequently have the disadvantage of exhausting insufficiently and unevenly on to the polyamide fibre and therefore of only achieving the desired effect when used in high concentrations. Normally, they can only be used for aftertreatment and in batch processes.

U.S. Pat. No. 4 655 783 discloses fibre-reactive bisazomethine-copper complexes which are obtainable e.g. from substituted or unsubstituted salicylaldehydes and aliphatic amines. Fibre materials treated with these complexes have good lightfastness properties and do not exhibit any undesirable inherent colour at the concentrations used.

It has now been found that a higher rate of exhaustion is achieved with copper complex compounds of bisazomethines and oximes, both of which contain OH-substituted phenyl radicals, than with the corresponding unsubstituted compounds. This result is significant in economic terms, as markedly less product is required when using these compounds.

The present invention thus relates to a process for the photochemical stabilization of undyed and dyed polyamide fibre material, or blends thereof with other fibres, using photochemically stabilizing compositions based on copper compounds of phenols, which process comprises treating the polyamide fibre material with fibre-reactive organic copper complex compounds of the reaction products of o-hydroxybenzoyl derivatives of the formula

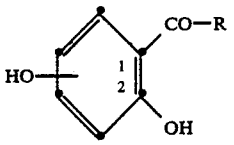

(1)

wherein R is hydrogen or $C_1$–$C_4$alkyl and the OH substituent is located in the 3-, 4- or 5-position, with aliphatic diamines or hydroxylamine.

The present invention further relates to the polyamide fibre material, or blends thereof with other fibres, photochemically stabilized by the present process.

Preferred copper complex compounds of the reaction products of o-hydroxybenzoyl derivatives of formula (1) with aliphatic diamines have the formula

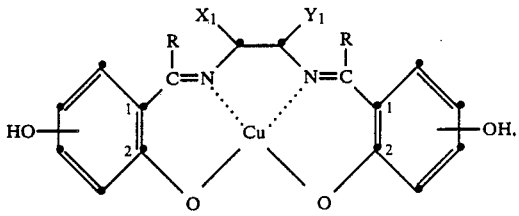

(2)

wherein R is as defined above and $X_1$ and $Y_1$ are each independently of the other hydrogen or $C_1$–$C_4$alkyl.

Of particular interest are water-insoluble copper complex compounds in which $X_1$ and $Y_1$ are hydrogen and the OH substituent is located in the 4-or 5-position, especially in the 4-position, and which have the formula

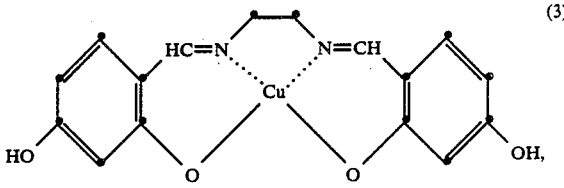

(3)

Preferred copper complex compounds of the reaction products of o-hydroxybenzoyl derivatives of formula (1) with hydroxylamine have the formula

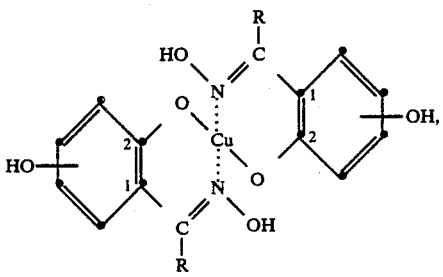

(4)

wherein R is as defined above and the hydroxyl substituent is located in the 4- or 5-position.

The most preferred copper complex compounds, however, are those of formula

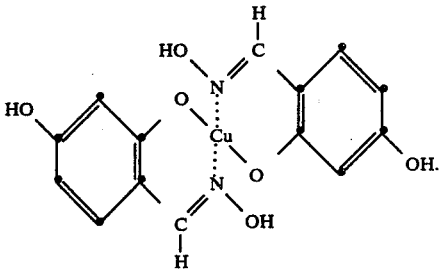

(5)

Some of the copper complex compounds of formula (2) are known, e.g. from M. Calvin, J. Am. Chem. Soc. 68, p. 949 (1946).

The compounds of formulae (2) and (3) are known and can be obtained in a manner known per se by reacting 2 equivalents of the appropriate OH-substituted o-hydroxybenzoyl derivative with 1 equivalent of the appropriate diamine to give the Schiff base and then metallizing the latter with copper salts. Another possibility, however, is first to form the copper complex of the appropriate salicylaldehyde and then to react this with the diamine to give the copper complex of the bisazomethine, of formula (2).

It is also possible to react the appropriate salicylaldehyde, the diamine and the copper salt direct in a single step, in a so-called one-pot process, to give the compound of formula (2) without isolation of the intermediates. These three methods of preparation are described by Pfeiffer in Liebigs Annalen der Chemie, 503, p. 84–130 (1933).

The copper complexes of formula (2) are conveniently applied from an aqueous bath and are preferably used in an amount such that 5 to 200 μg, especially 10 to 100 μg, of copper are applied to 1 g of polyamide fibre material.

The compounds of formula (2) are conveniently used as fine dispersions obtained by grinding in the presence of conventional dispersants.

The copper complex compounds of formula (4) are also known. They are obtainable by preparative processes known per se which are described e.g. in J. Chem. Soc., p. 314 (1933). To obtain these compounds, the reaction product of hydroxylamine with the appropriate OH-substituted o-hydroxybenzoyl derivative is reacted with a copper(II) salt, especially with a salt of a mineral acid, such as copper(II) chloride or copper(II) sulfate, preferably in an alcoholic, aqueous-alcoholic or aqueous medium.

If the copper complexes are used for the stabilization of dyed material, the fibre material can be treated with the said complexes before, during or after dyeing. The copper complex will conveniently be added direct to the dyeing liquors, padding liquors or printing pastes. Dyeing is carried out continuously or batchwise at a temperature of 20° to 130° C. In the continuous procedure, the copper complexes can be fixed by means of steam or heat in the temperature range from 100° to 200° C.

Polyamide material will be understood as meaning synthetic polyamide, e.g. polyamide 6, polyamide 6,6 or polyamide 12. In addition to pure polyamide fibres, blends of polyurethane and polyamide are also especially suitable, e.g. tricot material made of polyamide/polyurethane blended in a ratio of 70:30. In principle, the pure or blended polyamide material can be in different forms of presentation, e.g. as fibre, yarn, woven fabric or knitted fabric.

Polyamide material which is exposed to light and heat, e.g. that used as car upholstery material or carpeting, is particularly suitable for treatment by the present process.

Dyeing is carried out in conventional manner, e.g. with metal complex dyes or with anthraquinone dyes or azo dyes. The metal complex dyes used are the known types, especially the 1:2 chromium or 1:2 cobalt complexes of monoazo, disazo or azomethine dyes, large numbers of which are described in the literature. In addition to these, dyes of other classes are of course also possible, e.g. disperse or vat dyes.

The following Preparatory Procedures and Examples will serve to illustrate the invention. Parts and percentages are by weight. The percentages relating to the additives in the individual treatment baths or dyebaths are based on the fibre material, unless indicated otherwise.

PROCEDURES FOR THE PREPARATION OF THE COPPER COMPLEX COMPOUNDS

Example 1

A solution of 3.33 g of copper(II) acetate.$H_2O$ in 50 ml of dimethylformamide is added at 60° C. to a solution of 5.0 g of the azomethine of the formula

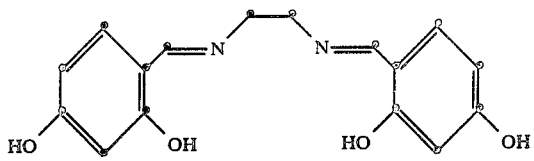

(101)

in 50 ml of dimethylformamide.

The mixture is then allowed to cool and diluted with 150 ml of ethanol and the precipitate is isolated by filtration, rinsed and dried to give 4.55 g (69% of theory) of the complex of the formula

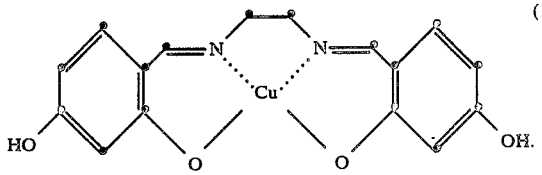

(102)

Elemental analysis: calculated: C 48,4%, H 4,6%, N 7,0%. found: C 48,3%, H 4,6%, N 7,5%.

Example 2

6.05 g of 2,4-dihydroxybenzaldoxime are dissolved at 40° C. in 39.5 ml of N sodium hydroxide solution. With stirring, a solution of 4.93 g of $CuSO_4.5H_2O$ in 60 ml of water is added, and the mixture is stirred at room temperature for a further 1 hour. The precipitated product is isolated by suction filtration, rinsed with water and dried to give 6.5 g (89.7% of theory) of a dark olive-green complex of the formula

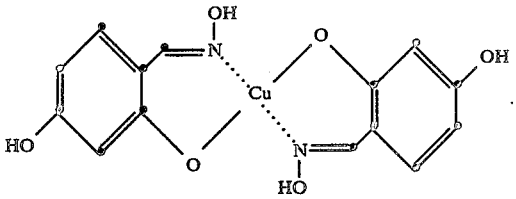

(103)

A sample of the substance is recrystallized from a dimethylformamide/water mixture (ratio 1:1), washed with ethanol and dried to give a light brown powder melting at 214° C. (with decomposition).

Elemental analysis: calculated: C 45,7%, H 3,3%, Cu 17,3%, N 7,6%. found: C 45,8%, H 3,6%, Cu 17,0%, N 7,6%.

Example 3

8 g of 2,5-dihydroxybenzaldehyde are dissolved at 60° C. in 40 ml of dimethylformamide. With stirring, 1.74 g of ethylenediamine and then a warm solution of 60° C. of 5.8 g of copper(II) acetate.$H_2O$ in 80 ml of dimethylformamide are added, and the mixture is stirred for one hour at 60° C. After cooling, the precipitate is isolated by suction filtration, rinsed with dimethylformamide and ethanol and dried to give 10.4 g (82% of theory) of the complex of the formula

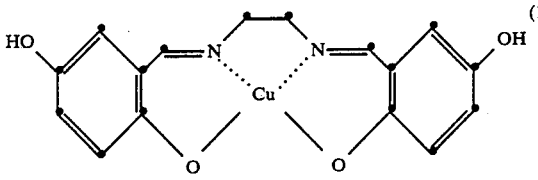

(104)

containing 1 mol of dimethylformamide as solvent of crystallization, in the form of a dark greyish green solid.

Elemental analysis:
calculated: C 52,3%, H 4,9%, N 9,7%.
found: C 52,5%, H 4,9%, N 9,6%.

Example 4

5.52 g of 2,3-dihydroxybenzaldehyde are dissolved in 50 ml of anhydrous ethanol. With stirring, 1.2 g of ethylenediamine are added, and the mixture is refluxed for 15 minutes. The mixture is then allowed to cool and the precipitate is isolated by filtration and dried to give 5.77 g (96% of theory) of the compound of the formula

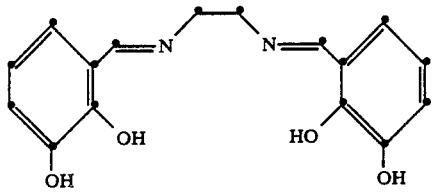

(105)

in the form of a yellowish orange powder melting at 231°-234° C.

5 g of the compound of formula (105) are dissolved at 50° C. in 40 ml of dimethylformamide. A warm solution of 50° C. of 3.32 g of copper(II) acetate.$H_2O$ in 60 ml of dimethylformamide is added to this solution, with stirring, and the mixture is stirred for one hour at 50° C. 100 ml of ethanol and 100 ml of water are then added and the resulting precipitate is isolated by filtration, rinsed with ethanol and dried to give 5.55 g (92% of theory) of the complex of the formula

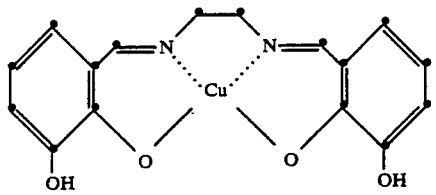

(106)

in the form of a dark pink powder.

Elemental analysis:
calculated: C 53,1%, H 3,9%, Cu 17,6%, N 7,7%.
found: C 53,0%, H 4,0%, Cu 17,7%, N 7,8%.

Example 5

6.68 g of resacetophenone oxime are dissolved at 40° C. in 80 ml of 0.5N sodium hydroxide solution. With stirring, a warm solution of 40° C. of 4.99 g of $CuSO_4.5H_2O$ in 25 ml of water is added to this solution, and the mixture is stirred at this temperature for 1 hour. After cooling, the resulting precipitate is isolated by filtration, rinsed with water until the washings are sulfate-free, and dried to give 7.58 g of the complex of the formula

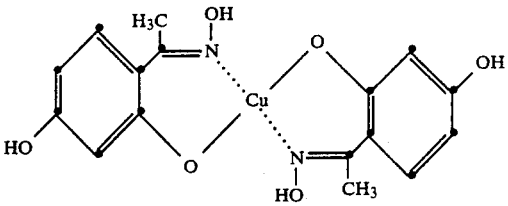

(107)

in the form of a light brown solid.

Elemental analysis:
calculated: C 48,5%, H 4,1%, Cu 16,0%, N 7,1%.
found: C 48,5%, H 4,1%, Cu 16,0%, N 7,2%.

Example 6

To 5 g of the compounds prepared according to Procedure 1 or 2 and a solution of 5 g of the condensation product of naphthalenesulfonic acid and formaldehyde, as dispersant, in 7.5 ml of water, are added 20 g of quartz beads (diameter approx. 1 mm) and the mixture is ground in a stirrer at approx. 1600 rpm until the particle size is below 3 μm. The dispersion is separated from the quartz beads by means of a fine strainer and adjusted with water to an active substance concentration of 10%. The dispersion is stabilized by stirring in 0.3% of carboxymethyl cellulose.

APPLICATION EXAMPLES

Example 7

Six 10 g samples of nylon tricot are treated in a dyeing machine having open treatment baths, e.g. an ®AHIBA dyeing machine, with liquors free from added dye (liquor ratio 1:20) which contain 2% of ammonium sulfate, 1 g/l of a dispersant, e.g. the condensation product of naphthalenesulfonic acid and formaldehyde, and the following ingredients:

Liquors 1-3: 0.01%, 0.04% and 0.1% of the compound of the formula

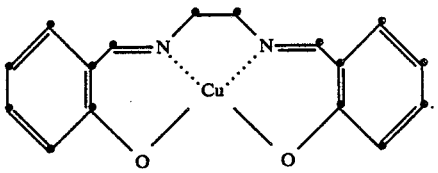

(108)

Liquors 4-6: 0.01%, 0.04% and 0.1% of the compound of formula (102).

Both compounds are used as formulations containing 10% of active substance. All the nylon samples are treated in parallel. The treatment is carried out initially for 5 minutes at 50° C. The temperature is then raised to 95° C. at a rate of 2° C./min. The samples are treated for 60 minutes at this temperature. The liquor is then cooled to 70° C. and the samples are rinsed warm, at 40° C., and then cold, centrifuged and dried at 60° C. in a circulating air drier.

The following Table shows the yields determined from the copper analyses of the samples.

| Experiment | Copper complex compound | | Cu μg/g of polyamide (= PA) in the batch | found in PA | yield [%] | μg of Cu/l remaining in the liquor |
|---|---|---|---|---|---|---|
| 1 | 0.01% | (108) | 18.9 | 15 | 79.4 | 0.195 |
| 2 | 0.04% | | 75.6 | 49 | 64.8 | 1.33 |
| 3 | 0.1% | | 189 | 115 | 60.9 | 3.705 |
| 4 | 0.01% | (102) | 17.5 | 17 | 97.1 | 0.025 |
| 5 | 0.04% | | 69.9 | 68 | 97.3 | 0.095 |
| 6 | 0.1% | | 174.8 | 173 | 99.0 | 0.090 |

The analytical data show that compound (102) exhausts onto the polyamide tricot markedly better than compound (108).

The proportion of copper compounds remaining in the liquor is substantially smaller, i.e. the wastewater is markedly less polluted.

Example 8

Five 10 g hanks of a Nylon staple yarn are dyed grey in 5 batches with the following dyes:

0,035% C.I. Acid Yellow 116
0,020% C.I. Red 251
0,145% C.I. Black Mix.

0 or 0.01% and 0.06% of compounds (108) and (102) are added to the individual batches of liquor. Dyeing is carried out as indicated in Example 7. The finished dyeings are tested for their lightfastness according to SN-ISO 105-BO2 (=xenon) and according to DIN 75.202 (=Fakra). The photochemical degradation of the fibres is determined by measuring the tensile strength and elongation at break according to SNV 97.461 of dyeings which have been exposed to light for 150 hours according to DIN 75.202.

In addition to these experimental results, the Table also shows the copper content remaining on the fibre, as determined by analysis.

| Dyeing/Additive | Cu-content μg/g of PA | Lightfastness* Xenon | F. 96 h | F. 192 h | Tensile strength/Elongation** in % after exposure to light |
|---|---|---|---|---|---|
| 1. no additive | — | −6–7 | −6 | 5 | 12.6/13.7 |
| 2. +0.01% of compound (108) | 11 | 6–7+ | 6–7 | −6 | 49.6/48.6 |
| 3. +0.06% of compound (108) | 63 | 6–7+ | 6–7+ | −6–7 | 62.7/62.5 |
| 4. +0.01% of compound (102) | 17.5 | 6–7+ | 6–7+ | 6–7 | 55/53.5 |
| 5. +0.06% of compound (102) | 101 | 7 | 6–7+ | 6–7 | 66.8/69 |

*F = Fakra (= DIN 75.202)
**unexposed starting material as standard

The differences in the individual dyeings which are obtained in the experiments result from the different copper contents.

Example 9

Five 10 g hanks of a nylon yarn are treated in an ®Ahiba dyeing machine with liquors free from dye, in the manner explained in Example 7, the individual liquors containing ammonium sulfate, dispersant and also the following ingredients:

Liquor 1: no additive (comparison)

Liquors 2–3: 0.05% and 0.25% of the compound of the formula

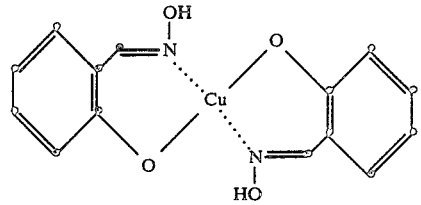

(109)

Liquors 4–5: 0.05% and 0.25% of compound (103).

The ingredients in liquors 2–5 are used as 10% dispersions.

The Cu content of the finished dyeings is determined and exposure to hot light according to DIN 75.202 is effected to determine the photochemical degradation.

The following Table lists the experimental results.

It is clearly evident that, on the one hand, the photochemical stability of the fibre material depends on the amount of copper complex exhausted and that, on the other hand, the affinity of the said complex for the fibre is a decisive factor.

| Liquor | Treatment with | Cu [μg/g of PA] | *Tensile strength/Elongation [%] after 192 h Fakra | after 288 h Fakra |
|---|---|---|---|---|
| 1 | without Cu-complex | — | 10.6/13.8 | destroyed |
| 2 | 0.05% (109)** | 5.2 | destroyed | destroyed |
| 3 | 0.25% (109)** | 39 | 50.9/47.9 | 30.6/35.6 |
| 4 | 0.05% (103)** | 9.2 | 25.9/24.9 | destroyed |
| 5 | 0.25% (103)** | 45 | 61.0/59.0 | 48.4/51.4 |

*unexposed starting material as standard
**used as ca. 10% dispersion.

We claim:

1. A process for the photochemical stabilization of undyed and dyed polyamide fibre material, or blends thereof with other fibre material, using photochemically stabilizing compositions based on copper compounds of phenols, which process comprises treating said polyamide fibre material with fibre-reactive organic copper complexes of the reaction products of o-hydroxybenzoyl derivatives of the formula

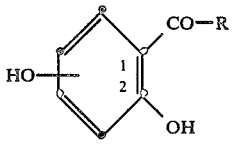

(1)

wherein R is hydrogen or $C_1$–$C_4$ alkyl and the OH substituent is located in the 3-, 4-or 5-position, with hydroxylamine.

2. A process according to claim 1, wherein a copper complex compound of the formula (4)

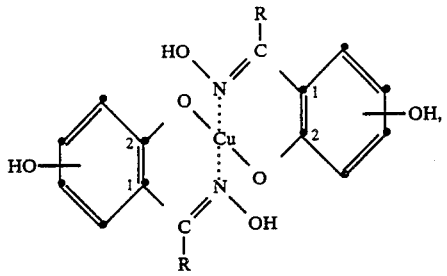

is used, wherein R is hydrogen or $C_1$–$C_4$alkyl and the OH substituents are located in the 4- or 5-position.

3. A process according to claim 2, wherein a copper complex compound of the formula (5)

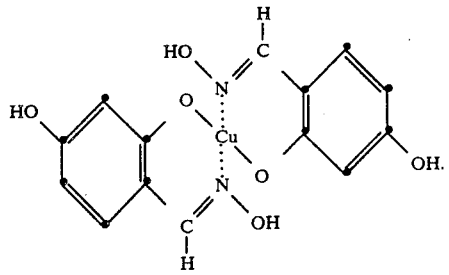

is used.

4. A process according to claim 3, wherein the copper complex is used in an amount such that 5 to 200 μg of copper are applied to 1 g of polyamide.

5. A process according to claim 3, wherein blends of polyamide and polyurethane are used.

6. A process according to claim 1, wherein the copper complex is added directly to a dyebath.

7. A process according to claim 1, wherein the process is carried out continuously or batchwise in the temperature range from 20° to 130° C.

8. A process according to claim 7 wherein the process is carried out continously and the copper complexes are fixed at a temperature in the range from 100° to 200° C.

9. Dyed or undyed polyamide fibre material and fibre blends treated by a process as claimed in claim 1.

* * * * *